United States Patent [19]

Guntharp et al.

[11] Patent Number: 4,775,262

[45] Date of Patent: Oct. 4, 1988

[54] CONCRETE FINISHING MACHINE WITH VIBRATING COMPACTOR UNIT

[75] Inventors: Robert L. Guntharp, Howard, Ohio; Murray A. Rowe, Canton, S. Dak.

[73] Assignee: CMI Corporation, Oklahoma City, Okla.

[21] Appl. No.: 76,154

[22] Filed: Jul. 21, 1987

[51] Int. Cl.[4] ..... E01C 19/28

[52] U.S. Cl. ..... 404/103; 404/117; 404/124; 404/128

[58] Field of Search ..... 404/101, 102, 103, 105, 404/113–120, 128, 124

[56] References Cited

U.S. PATENT DOCUMENTS

| | | | |
|---|---|---|---|
| 1,623,142 | 4/1927 | Walsh | 404/124 |
| 2,728,277 | 12/1955 | McRae | 404/117 |
| 3,176,597 | 4/1965 | Seaman | 404/117 |
| 3,253,522 | 5/1966 | Piper | 404/113 |
| 3,283,678 | 11/1966 | Domenighetti | 404/117 |
| 3,528,348 | 9/1970 | Rowe et al. | 404/120 |
| 3,703,128 | 11/1972 | Fransson | 404/128 |
| 3,738,763 | 6/1973 | Glesmann | 404/119 |
| 3,753,621 | 8/1973 | Dale | 404/116 |
| 3,850,541 | 11/1974 | Baillet et al. | 404/114 |
| 3,870,427 | 3/1975 | Allen | 404/103 |
| 4,068,970 | 1/1978 | Rowe | 404/120 |
| 4,256,415 | 3/1981 | Rowe et al. | 404/116 |
| 4,320,987 | 3/1982 | Rowe et al. | 404/115 |
| 4,323,321 | 4/1982 | Dale | 404/105 |
| 4,702,644 | 10/1987 | Cioffi | 404/128 |
| 4,708,520 | 11/1987 | Rowe | 404/103 |

FOREIGN PATENT DOCUMENTS

| | | | |
|---|---|---|---|
| 2349180 | 4/1975 | Fed. Rep. of Germany | 404/124 |
| 699077 | 11/1979 | U.S.S.R. | 404/117 |

*Primary Examiner*—Stephen J. Novosad
*Assistant Examiner*—John F. Letchford
*Attorney, Agent, or Firm*—Emrich & Dithmar

[57] ABSTRACT

A concrete finishing machine includes a surfacing unit having two finishing cylinders with two augers mounted in line with the two cylinders, and a pair of compacting rollers located on either side of the augers, suspended by a frame which is attached to the surfacing unit by a mounting assembly which allows adjustment in the vertical height of the compacting rollers relative to the surfacing unit for setting the compacting rollers relative to the surface being finished. The frame is adapted to be vibrated for vibrating the compactor rollers in use. In one embodiment, the compacting rollers each have rectangular fins projecting radially outward from the roller and extending the length thereof. In another embodiment, the compacting rollers each have a serrated outer surface.

22 Claims, 3 Drawing Sheets

CONCRETE FINISHING MACHINE WITH VIBRATING COMPACTOR UNIT

BACKGROUND OF THE INVENTION

This invention relates to concrete finishing machines including surfacing units for finishing concrete surfaces, and more particularly, to a vibrating compactor assembly for use with such concrete finishing machines.

Concrete vibrator apparatus for use in vibrating concrete ahead of a concrete finishing unit on highways, and the like, is known in the art. Various types of concrete vibrating apparatus are known including concrete vibrator apparatus wherein the vibrators are moved into and out of concrete to be vibrated in a substantially vertical or rearwardly extending direction and moved forwardly along, or laterally across a highway or the like, in a step-like movement. Other concrete vibrator apparatus include vibrators which are dragged forwardly along the highway, or the like, ahead of the concrete finishing units. Another concrete vibrator apparatus, disclosed in U.S. Pat. No. 4,320,987 of Murray A. Rowe, et al, includes a vibrator unit movable back and forth transversely over the roadway, with the vibrator mechanism disposed in the concrete to be vibrated and being raisable and lowerable relative to the concrete to be vibrated. The vibrator mechanism is in the form of generally L-shaped members suspended on a support frame and actuated as by an hydraulic motor or the like.

In another arrangement for concrete vibrating apparatus incorporated into a concrete finishing machine as disclosed in U.S. Pat. No. 4,068,970 to Murray A. Rowe, the concrete finishing apparatus includes a screed mechanism for striking-off and smoothing spread concrete. The screed mechanism is vibrated to vibrate the concrete to the proper density and best quality finish during finishing.

Although these known concrete vibrator apparatus improve the quality of the concrete surface finish, these finishing processes generally require the use of water in leveling of the concrete, resulting in dilution of the concrete.

SUMMARY OF THE INVENTION

It is an object of the present invention to provide an improved concrete vibrating assembly for concrete finishing machines.

Another object of the present invention is to provide a vibrating aggregarte compactor assembly for use with concrete finishing machines.

Another object of the invention is to provide a concrete vibrator appartus having an improved surface configuration for affording optimum density of the concrete to obtain the best quality finish.

Another object of the invention is to provide a concrete vibrating apparatus adapted for mounting to a concrete finishing machine and which includes vertical height adjustment means for obtaining a desired vibrator surface pressure.

These and other objects are achieved by the present invention which has provided a concrete finishing machine of the type embodying an elongated main frame adapted for movement longitudinally along a roadway or the like being surfaced, and a surfacing unit for finishing a concrete surface, the surfacing unit being adapted for movement back and forth along the main frame laterally of the roadway and including finishing cylinder means rotatably mounted to said main frame, and including compacting means which is comprised of a sub-frame, compactor rollers, vibrating means, and mounting means.

The sub-frame includes means for rotatably mounting the compactor rollers in a parallel spaced relation. The compacting rollers each comprise an elongated cylinder having projections extending radially from the peripheral edge of the cylinder in a spaced relation around the peripheral edge of the cylinder. A vibrating means is coupled to the sub-frame for vibrating same and the compacting rollers supported thereby. The mounting means includes suspension means mounting the sub-frame to the main frame of the concrete finishing machine, and isolating means interposed between the suspension means and the sub-frame for preventing the transmission of vibrations from the sub-frame to the main frame as the sub-frame is vibrated.

The invention consists of certain novel features and structural details hereinafter fully described, illustrated in the accompanying drawings, and particularly pointed in the appended claims, it being understood that various changes in the details may be made without departing from the spirit, or scarificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF THE PREFERRED EMBODIMENTS

Figure 1:
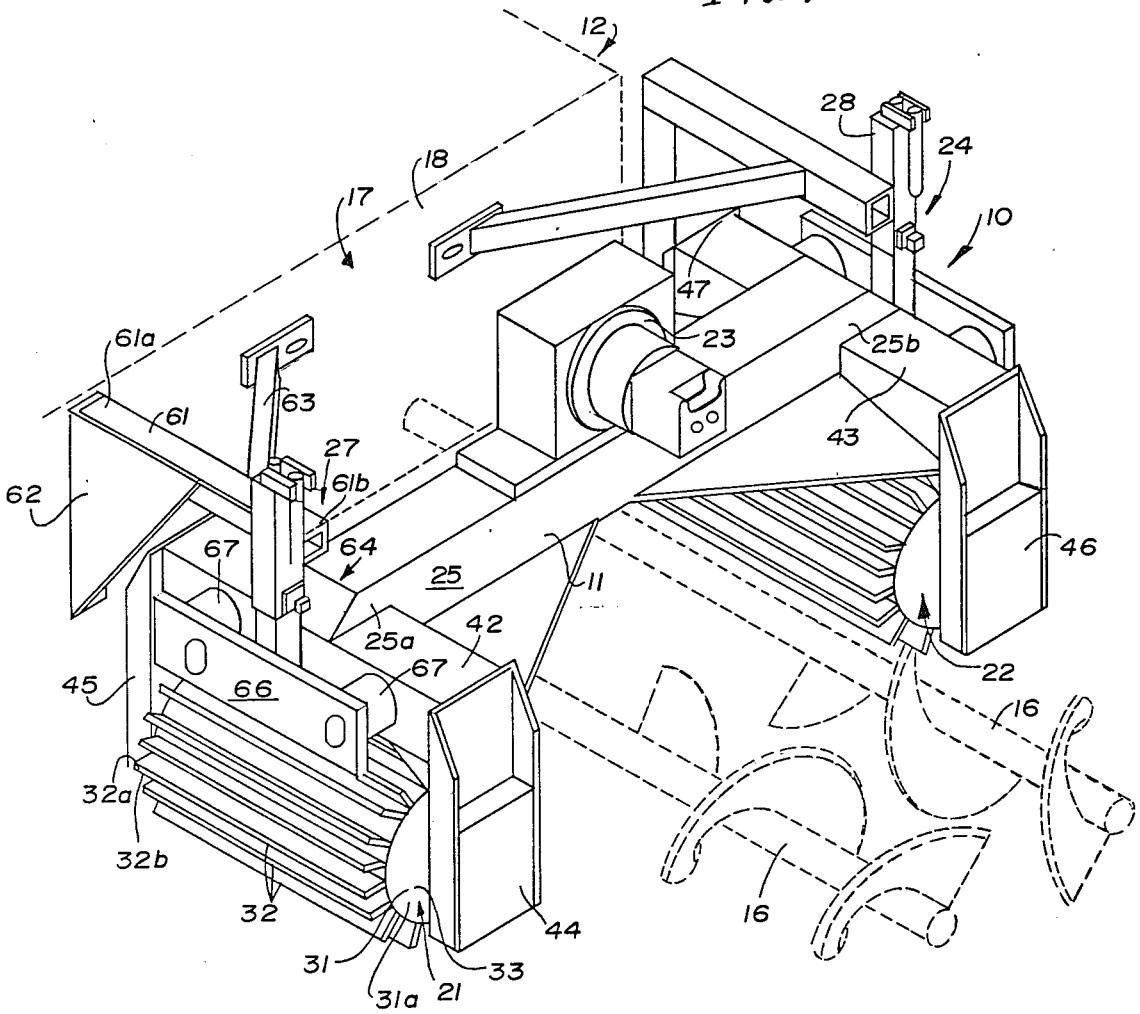
FIG. 1 is a perspective view of a vibrating aggregate compactor assembly provided in accordance with the present invention for use with a concrete finishing machine.
Figure 2:
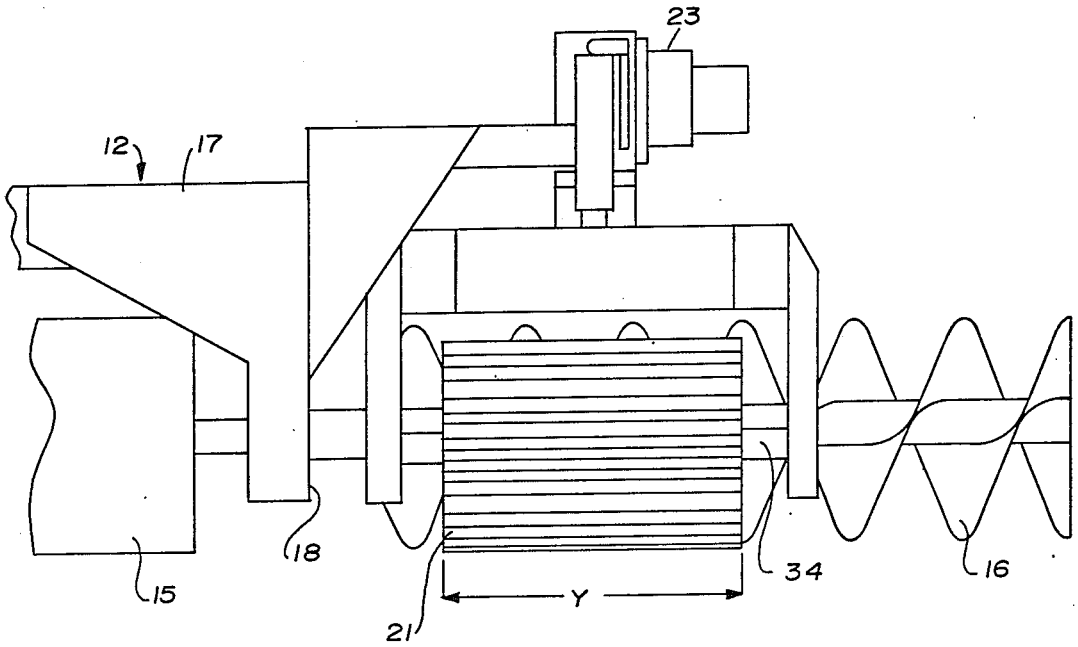
FIG. 2 is a side elevational view of the compactor assembly shown in FIG. 1.
Figure 3:
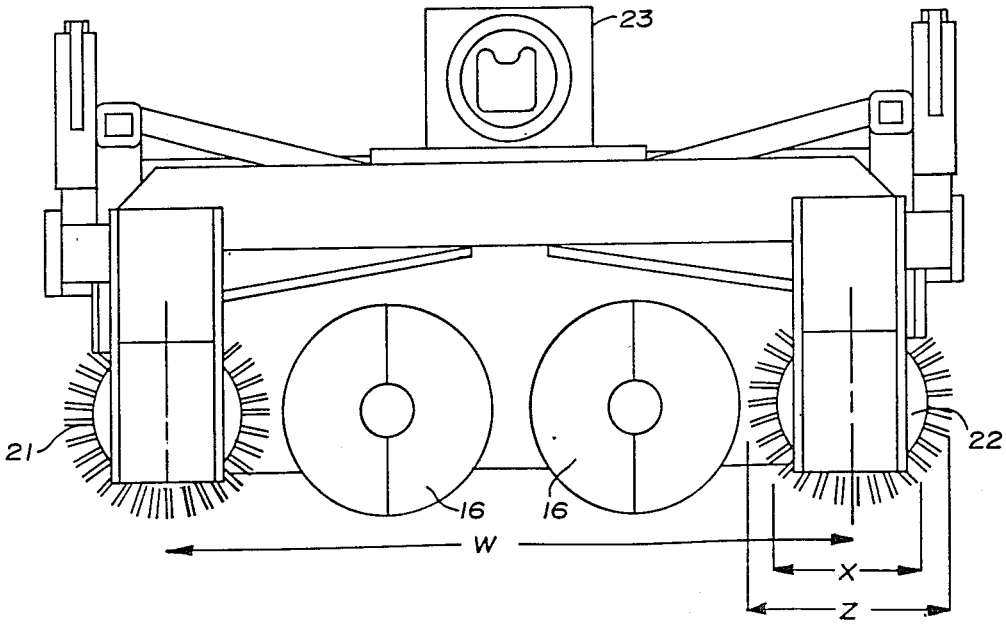
FIG. 3 is a front elevational view of the compactor assembly.

Referring to FIGS. 1–3, the vibrating aggregate compactor assembly 10 provided by the present invention is shown mounted to a roller finisher apparatus or surfacing unit of a concrete finishing machine, only a portion of which is shown and indicated by reference numeral 12 (FIG. 2). The concrete finishing apparatus may be of the type embodying an elongated main frame (not shown) adapted for movement longitudinally along a roadway being surfaced, carrying with it the surfacing unit which is adapted for movement back and forth along the main frame laterally of the roadway.

The roller finisher apparatus 12 includes a surfacing unit comprised of a pair of finishing rollers, one of which is shown in FIG. 2 and given the reference numeral 15 a pair of augers 16, and a suitable support frame 17 including a forward panel 18. The augers 16 are disposed forwardly of the front of respective cylinders, such as cylinder 15, and aligned axially thereof in substantially horizontal, uniplanar spaced relation to draw concrete toward the space between the augers as well as longitudinally outwardly along the augers, away from the finishing cylinders, as is known in the art, to turn the concrete to grade prior to finishing by the finishing rollers. Examples of concrete finishing machine with dual augers are disclosed in Rowe et al, U.S. Pat. No. 3,528,348, entitled CONCRETE FINISHING MACHINES, and in the U.S. Pat. No. 4,708,520 entitled CONCRETE FINISHING MACHINE WITH ADJUSTABLE AUGER UNIT, which is assigned to the assignee of the present application. The manner in which the concrete roller finisher apparatus operates is known in the art and is described in the referenced patents and accordingly will not be described in detail herein.

With reference to FIGS. 1-3, the compactor assembly 10 provided by the present invention includes a pair of compacting rollers 21 and 22, a vibrating apparatus 23, and a sub-frame 24 including a compacting roller support frame 25 which supports the compacting rollers 21 and 22, and a pair of adjustable sub-assemblies 27 and 28 which attach the support frame 24 to the roller finisher apparatus 12.

Each of the compacting rollers 21 and 22 includes a hollow tubular member 31 having a plurality of projections in the form of fins 32 projecting outward radially from the peripheral edge of the tubular member 31. Each fin 32 has parallel opposing planar surfaces **32*a* and 32*b* which extend generally normal to the peripheral edge of the cylinder 31, defining a flat, rectangular plate-like configuration for the fin. In the disclosed embodiment, the fins 32 extend the length of the tubular member 31**. However, the fins may be segmented along the length of the tubular member or projections of other configurations may be used, such as rod type projections.

The tubular member is a hollow cylinder of light weight steel or aluminium. Each tubular member 31 is closed at each end by end plates, such as end plate 33 at end **31*a*. The end plates support an axle 34** extending axially of the tubular member and projecting outwardly at opposite ends thereof to facilitate rotatable mounting of the compacting roller to the support frame. The fins are welded or otherwise suitably attached to the outer surface of the tubular member.

In one compactor assembly constructed, the tubular member 31 has an outer diameter "x" of 5½" and is 11" in length "y". The compacting roller has thirty-two fins 32 each 1" in radial length and 11" in axial length, extending along the periphery of the cylinder or tubular member 31. Thus, the overall diameter "z" of the compactor roller 21 is of 7½". Each of the fins is ¼" thick. The fins are spaced apart on 1" centers (measured between tips of adjacent fins) along the circumference of the tubular member.

The support frame 25 includes a cross beam 41, a pair of side beams 42 and 43 and a pair of support members including support members 44 and 45 associated with side member 42 and support members 46 and 47 associated with support member 43.

The side members 42 and 43 extend in a parallel spaced relationship, normal to the forward panel 18 and spaced forwardly thereof. The cross member 41 extends parallel to the panel 18 and has its ends **25*a* and 25*b* connected to respective side members 42 and 43 near the midpoints thereof. The vibrating apparatus 23, which is mounted on the cross beam 41**, comprises an eccentric motor driven hydraulically or electically to import vibrational movement to the support frame and the compacting rollers supported thereby.

Support member 44 depends from the forward end **42*a* of side member 42 and support member 45 depends from the rearward end 42*b* of side member 42. Each of the support members 44 and 45 includes a bearing (not shown) which receives the end of the axle of the compacting roller 21 supporting the compacting rollers with its axis of rotation extending parallel to that of the augers 16 and finishing cylinders, and normal to the panel 18**.

Similarly, side member 43 and support members 46 and 47 support compactor roller 22 with its axis of rotation extending parallel to that of the augers 16 and finishing cylinders, and normal to the panel 18. The compacting rollers 21 and 22 are supported on opposite sides of the augers 16 with their rotational axis spaced apart, for example, by a distance of 25.5". The compacting rollers 21 and 22 are mounted for free rotation within their bearings as the surfacing unit 12 is driven back and forth in use. The dual augers move concrete forward on every pass, leaving the proper amount of concrete for ideal consolidation because they extend in front of the vibraing compacting rollers. The compacting rollers depress, rock and vibrate the surface of concrete with each pass of the surfacing unit.

The adjustable support assemblies 27 and 28 support the compactor assembly 10 relative to the roller finisher apparatus 12. The adjustable support assemblies 27 and 28 are mirror images of one another and thus only assembly 27 will be described.

Figure 4:
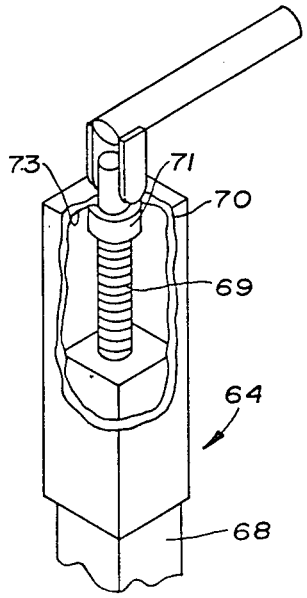
FIG. 4 is an enlarged, fragmentary perspective view, partially cut away, of one of the vertical adjusting members of the compactor assembly.

Referring to FIGS. 1 and 4, the support assembly 27 includes a cantilever mounted beam 61, a gusset plate 62, a brace member 63, vertical adjustor assembly 64, side bar 66 and isolators 67.

The cantilever beam 61 has its proximal end **61*a* attached to the forward surface of panel 18 by gusset plate 62. The brace member 63 extends at an angle between the panel 18 and is attached to the beam 61 near its distal end 61*b*. The vertical adjustor assembly 64 is attached to the beam 61 near its distal end. The vertical adjustor assembly 64 embodies a solid rod member 68 with a rectangular cross-section, having a feed screw 69 threadably mounted therein at its upper end, and a tubular outer member 70 of rectangular cross-section, which is received on the rod member 68 in telescopic relation and slidably movable therealong. The feed screw 69 has a collar 71 at its upper end which engages the outer tubular member 70 on the underside 73** of its top surface.

A hand crank 74 secured to the upper end portion of the feed screw 69, facilitates adjustment of the feed screw and the tubular member 70 relative to rod member 68.

The side bar 66 is attached to the rod member 68 near its bottom end and is provided with a pair of appertures 76 which facilitate attachment of the side bar 66 to side member 42 of the support frame 25 in a suitable manner as by mounting bolts 77. The isolators or cushion mounts of rubber or other resilient material 67 are interposed between the inner surface **66*a* of the side bar 66 and the outer surface 42*a* of the side member 42, defining an isolating means for preventing the transmission of vibrations from the sub-frame 24 to the surfacing unit 12** as the sub-frame is vibrated while in use.

The feed screw permits vertical reciprocating movement up or down of the tubular member 70 with clockwise or counterclockwise turning of the feed screw 69 to raise of lower the outer tubular member 70 relative to the rod member 68, thereby raising or lowering the compactor rollers relative to a concrete surface being finished.

The movement of the compacting rollers between a fully raised and a fully lowered position is effective to dispose them in upwardly withdrawn position relative to concrete to be vibrated, and to dispose them in the desired lowered position for vibrating the concrete, respectively. In this manner, the vertical adjustor assembly permits adjustment of height of the sub-frame 24 and, therefore, of the compacting rollers 21,22 relative to the roadway being surfaced. The height of the compacting rollers is set to cause the compactor rollers to penetrate the surface of the concrete being worked to a depth of about ½ inch.

Figure 5:
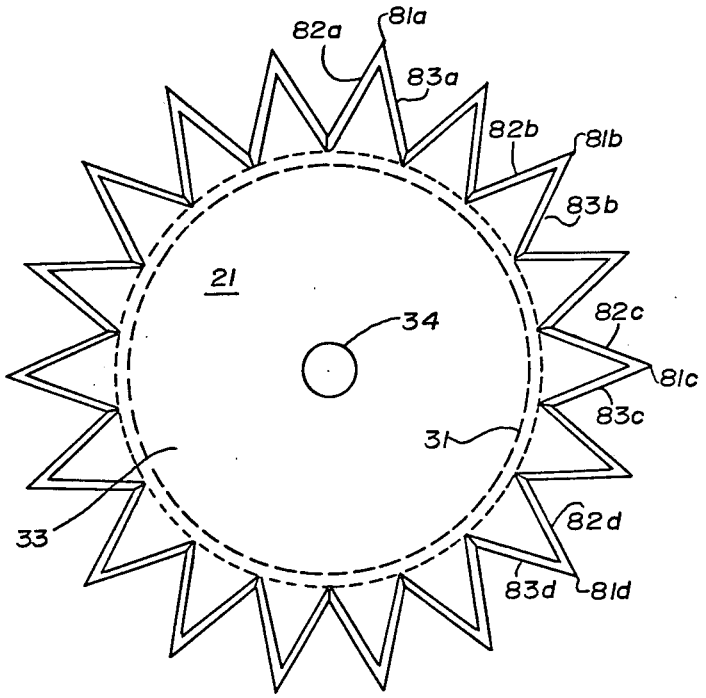
FIG. 5 is an end elevational view of a second embodiment for a compactor roller.
Figure 6:
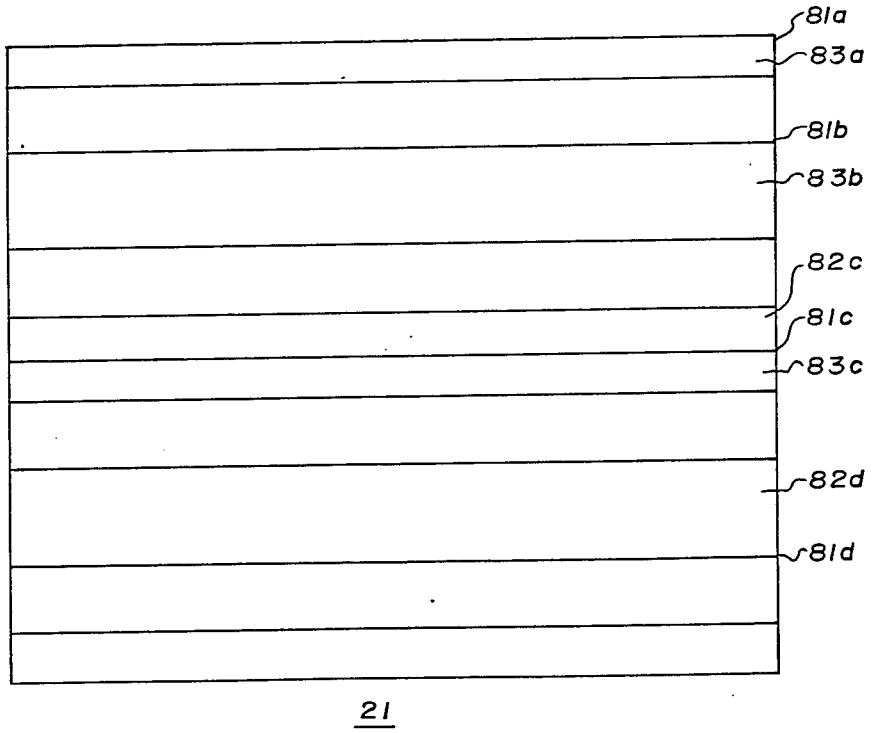
FIG. 6 is a front elevational view of the compactor roller shown in FIG. 5.

Referring to FIGS. 5 and 6, in accordance with a further embodiment of the invention, a compacting roller 21' has a serrated outer surface configuration, defined by a series of teeth 81, including teeth 81, **81*b*, 81*c*, 81*d*, etc., formed thereon. Each tooth is defined by a pair of planar surfaces, such as surfaces 82*a*–82*d*, 83*a*–83*d*, for teeth 81*a*–81*d* which extend outward at an angle relative to the peripheral edge surface of the cylinder 31 from respective base lines 84*a*–84*d* to an apex 85*a*–85*d*, defining a generally triangular cross-section for the projections or teeth. Each tooth or projection extends the length of the cylinder 31 as shown in FIG. 6. The slanting planar surfaces of the projections 81 in accordance with this embodiment, provide a face for the compactor roller which is self-relieving, preventing concrete from accumulating between adjacent projections on the compacting roller outer surface as the compacting roller 21'** moves through the surface of the concrete being finished.

In one compacting roller 21' constructed, the cylinder 31 has a diameter of 6⅜", the height of the teeth from base to apex is 1⅛". The center to center spacing of the teeth is 1" and the projections are ¼" in thickness and ¾" in radial extent.

In use of the compactor assembly 10 with a concrete finishing machine, the concrete finishing machine is positioned over a roadway or the like, straddling the roadway to be surfaced and adjusted to provide the proper positioning of the surfacing unit 12 relative to the roadway. The manner in which such surfacing unit is adjusted is known in the art and is described for example in the referenced patents for specific units. Briefly, the finishing cylinders 15 are set at a height sufficient to establish to correct grade for the finished concrete surface, and the augers 16 are adjusted to provide the proper amount of concrete at the forward edge of the finishing cylinders to permit the finishing cylinders to provide optimum finishing. The concrete finishing machine is operated in the manner known in the art with the surfacing unit 12 being driven back and forth along a carriage track, reversing each time that it reaches the end position, as the concrete finishing machine is advanced forward along the roadway.

Referring to FIGS. 1–3, the compacting rollers 21 and 22 are adjusted as to their vertical height relative to the surface being finished to provide the desired depth of penetration of the projections into the surface of the concrete and to provide the desired surface penetration for the compacting rollers in use. By way of example, the height of the compacting rollers is set so that the compacting rollers penetrate the concrete surface to a depth of ½ inch. This adjustment is made in the manner described above by the vertical adjusting apparatus 27 and 28, turning the feed screws 69 by way of the associated hand cranks 74 to raise or lower the compacting rollers 21,22 relative to the suspension beam 61.

After the sub-frame has been adjusted to locate the compacting rollers at the desired height, the compacting rollers rotate freely, moving the projections through the surface of the concrete, as the surfacing unit 12 is driven back and forth. When the vibrating motor is activated, vibrations are transmitted through the sub-frame 24 to the compacting rollers 21,22, such that the compacting rollers are vibrated to vibrate the concrete to the proper density and best quality finish during finishing by the finishing rollers 15. The compacting rollers push the concrete aggregate downward, causing it to settle well below the surface, leaving finer concrete material at surface level. This results in a better seal on the concrete and enables the finishing rollers to provide a smoother surface finish. Also, the vibrating action renders the compacting rollers self-cleaning. Moreover, the vibrating compactor provided by the invention avoids the need to introduce water into the poured concrete prior to the finishing operation.

We claim:

1. In a concrete finishing machine of the type embodying an elongated main frame adapted for movement longitudinally along the roadway or the like being surfaced, and a surfacing unit for finishing a concrete surface, the surfacing unit being adapted for movement back and forth along the main frame laterally of the roadway and including finishing cylinder means rotatably mounted to the main frame, compacting means comprising:

a sub-frame;

a plurality of compacting rollers;

vibrating means;

and mounting means;

said sub-frame including means for rotatably mounting said compacting rollers in a parallel spaced relation, with a portion of said compacting rollers penetrating the concrete surface, said compacting rollers each comprising an elongated cylinder having projections extending outward radially from the peripheral edge of said cylinder in a spaced relation around the peripheral edge of the cylinder and extending the length of said cylinder, said vibrating means coupled to said sub-frame for vibrating same and said compacting rollers supported thereby, and said mounting means including suspension means mounting said sub-frame to the main frame of the concrete finishing machine, and isolating means interposed between said suspension means and said sub-frame for preventing the transmission of vibrations from said sub-frame to the main frame as said sub-frame is vibrated.

2. A concrete finishing machine according to claim 1, wherein said projections each have first and second planar surfaces extending the length of said cylinder, said planar surfaces of each projection extend substantially normal to the peripheral edge of said cylinder and generally parallel to one another, defining a generally rectangular configuration for the projection.

3. A concrete finishing machine according to claim 2, wherein the radial length of said planar surfaces is in the range of one-fourth inch to one inch.

4. A concrete finishing machine according to claim 1, wherein said projections each have first and second planar surfaces extending the length of said cylinder, said planar surfaces of each projection extend toward one another at an angle to the peripheral edge of said cylinder, defining a generally triangular cross-section for the projection.

5. A concrete finishing machine according to claim 1, wherein said projections are disposed at one inch spacings along the peripheral edge of said cylinder.

6. A concrete finishing machine according to claim 1, wherein said vibrating means is attached to said sub-frame, said isolating means comprising a resilient means connecting said sub-frame to said suspension means.

7. A concrete finishing machine according to claim 6, wherein said suspension means includes adjustment means for adjusting the vertical height of said sub-frame relative to the main frame to vary the depth of penetration of said compacting rollers relative to the surface of the concrete surface.

8. A concrete finishing machine according to claim 7, wherein said suspension means comprises first and second cantilever mounted members, said adjustment means including first and second vertical adjustment mechanisms attached to the distal ends of said first and second cantilever members, respectively, said resilient means including at least first and second cushion members connecting said first and second adjustment mechanisms, respectively, to said sub-frame.

9. A concrete finishing machine according to claim 8, wherein each of said adjustment mechanisms comprises a first and second telescoping tubular members, a feed screw threadably received by said first tubular member and turnable therewithin for varying the vertical height of said second tubular member relative to said first tubular member, one of said tubular members connected to an associated cantilever member and the other one of said tubular members connected through an associated resilient means to said sub-frame.

10. In a concrete finishing machine of the type embodying an elongated main frame adapted for movement longitudinally along a roadway or the like being surfaced, a surfacing unit for finishing a concrete surface, the surfacing unit being adapted for movement back and forth along the main frame laterally of the roadway and including first and second finishing cylinders each rotatably mounted to said main frame and extending in a parallel speed relation, and first and second augers mounted for rotation with said first and second finishing cylinders, respectively and extending in a parallel spaced relation, compacting means comprising:

a sub-frame;

first and second compacting rollers;

vibrating means;

and mounting means;

said sub-frame including means for rotatably mounting said compactor rollers in a parallel spaced relation adjacent to said auger, said compacting rollers each comprising an elongated cylinder having projections extending radially from the peripheral edge of said cylinder in a spaced relation around the peripheral edge of the cylinder, each of said projections having first and second generally planar surfaces extending the length of said cylinder, said vibrating means coupled to said sub-frame for vibrating same and said compacting rollers supported thereby, and said mounting means including suspension means mounting said sub-frame to the main frame of the concrete finishing machine, and isolating means interposed between said suspension means and said sub-frame for preventing transmission of vibrations from said sub-frame to the main frame as said sub-frame is vibrated.

11. A concrete finishing machine according to claim 10, wherein said augers extend outwardly in cantilever fashion from the surfacing unit, the augers each having a proximal end and a distal end, said compacting rollers located near the proximal ends of the augers on opposite sides of the augers.

12. A concrete finishing machine according to claim 11, wherein the finishing cylinders and the augers are aligned axially in pairs, said augers extending between said compactor rollers.

13. A concrete finishing machine according to claim 10, wherein said planar surfaces of each projection extend substantially normal to the peripheral edge of said cylinder and generally parallel to one another, defining a generally rectangular configuration for the projection.

14. A concrete finishing machine according to claim 10, wherein said planar surfaces of each projection extend toward one another at an angle to the peripheral edge, defining a generally triangular cross-section for the projection.

15. A concrete finishing machine according to claim 10, wherein said vibrating means is attached to said sub-frame, said isolating means comprising a resilient means connecting said sub-frame to said suspension means.

16. A concrete finishing machine according to claim 10, wherein said suspension means includes adjustment means for adjusting the vertical height of said sub-frame relative to the mainframe to vary the height of said compacting rollers relative to the roadway.

17. In a concrete finishing machine including frame means supporting a surfacing apparatus for finishing a concrete surface and having means for establishing a desired grade for the finished concrete surface, compacting means comprising:

a sub-frame;

at least one compacting roller;

vibrating means;

and mounting means;

said sub-frame including means for rotatably mounting said compacting rollers, said compacting roller comprising an elongated cylinder having projections extending radially from the peripheral edge of said cylinder in a spaced relation around the periphery of said cylinder, each of said projections having first and second generally planar surfaces extending the length of said cylinder, said vibrating means coupled to said sub-frame for vibrating same and said compacting roller supported thereby, and said mounting means including suspension means mounting said sub-frame to the frame means of the concrete finishing machine with said compacting roller suspended at a height above the concrete surface being finished to provide a desired depth of penetration of said projections into the concrete surface, and isolating means interposed between said suspension means and said sub-frame for preventing the transmission of vibrations from said sub-frame to the frame means of the concrete finishing machine as said sub-frame is vibrated.

18. A concrete finishing machine according to claim 17, wherein said planar surfaces of each projection extend substantially normal to the peripheral edge of said cylinder and generally parallel to one another, defining a generally rectangular configuration for the projection.

19. A concrete finishing machine according to claim 17, wherein said planar surfaces of each projection extend toward one another at an angle to the peripheral edge, defining a generally triangular cross section for the projection.

20. A concrete finishing machine according to claim 17, wheren said vibrating means is attached to said sub-frame, said isolating means comprising a resilient means connecting said sub-frame to said suspension means.

21. A concrete finishing machine according to claim 17, wherein said suspension means includes adjustment means for adjusting the vertical height of said sub-frame to vary the height of said compacting rollers relative to the roadway.

22. In a concrete finishing machine of the type embodying an elongated main fram eadapted for movement longitudinally along the roadway or the like being surfaced and a surfacing unit for finishing a concrete surface, the surfacing unit being adapted for movement back and forth along the main frame laterally of the roadway and including finishing cylinder means rotatably mounted to the main frame, compacting means comprising:

a sub-frame;

a plurality of compacting rollers;

vibrating means;

and mounting means;

said sub-frame including means for rotatably mounting said compacting rollers in a parallel spaced relation, said compacting rollers each comprising an elongated cylinder having projections extending outward radially from the peripheral edge of said cylinder in a spaced relation around the peripheral edge of the cylinder and extending the length of said cylinder, said vibrating means coupled to said sub-frame for vibrating same and said compacting rollers supported thereby, and said mounting means including suspension means mounting said sub-frame to the main frame of the concrete finishing machine with said compacting rollers suspended at a height above the concrete surface being finished to provide a desired depth of penetration of said projections into the concrete surface, and isolating means interposed between said suspension means and said sub-frame for preventing the transmission of vibrations from said sub-frame to the main frame as said sub-frame is vibrated.

* * * * *